US010075803B2

(12) United States Patent
Katayama

(10) Patent No.: US 10,075,803 B2
(45) Date of Patent: Sep. 11, 2018

(54) SPEAKER DEVICE

(71) Applicant: Yamaha Corporation, Hamamatsu-shi, Shizuoka-ken (JP)

(72) Inventor: Masaki Katayama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/609,350

(22) Filed: May 31, 2017

(65) Prior Publication Data

US 2017/0265017 A1 Sep. 14, 2017

Related U.S. Application Data

(63) Continuation of application No. PCT/JP2015/083721, filed on Dec. 1, 2015.

(30) Foreign Application Priority Data

Dec. 1, 2014 (JP) ..... 2014-243296

(51) Int. Cl.
*H04R 5/02* (2006.01)
*H04S 7/00* (2006.01)
(Continued)

(52) U.S. Cl.
CPC ..... *H04S 7/303* (2013.01); *H04R 1/025* (2013.01); *H04R 1/403* (2013.01); *H04R 3/04* (2013.01);
(Continued)

(58) Field of Classification Search
USPC ..... 381/17, 21, 92, 98, 300, 303, 387, 386
See application file for complete search history.

(56) References Cited

U.S. PATENT DOCUMENTS

2004/0023697 A1* 2/2004 Komura ..... H04M 1/0202 455/569.1
2012/0039476 A1* 2/2012 Cha ..... H04R 1/26 381/17
(Continued)

FOREIGN PATENT DOCUMENTS

EP 2 104 375 A2 9/2009
JP 2009-17094 A 1/2009
(Continued)

OTHER PUBLICATIONS

International Search Report (PCT/ISA/210) issued in PCT Application No. PCT/JP2015/083721 dated Feb. 16, 2016 with English translation (3 pages).
(Continued)

*Primary Examiner* — Yosef K Laekemariam
(74) *Attorney, Agent, or Firm* — Crowell & Moring LLP

(57) ABSTRACT

Provided is a speaker device, which includes speaker units having different diameters and sound emission directions, and which is capable of suppressing variations in sound quality at a listening position, which are caused by changing an orientation in which the speaker device is installed. A speaker device has first and second speaker units, which have different diameters and sound emission directions, mounted thereto. A controller is configured to control, depending on the orientation in which the device is installed, an equalizer correction unit to correct frequency characteristics of acoustic signals input to the first and second speaker units so that sound quality is not varied at the listening position depending on the difference in diameter and sound emission direction.

15 Claims, 3 Drawing Sheets

(51) Int. Cl.

| | |
|---|---|
| ***H04R 3/04*** | (2006.01) |
| ***H04R 1/02*** | (2006.01) |
| ***H04R 1/40*** | (2006.01) |
| ***H04R 3/14*** | (2006.01) |
| ***H04R 5/04*** | (2006.01) |

(52) U.S. Cl.
CPC ..... *H04R 3/14* (2013.01); *H04R 5/02* (2013.01); *H04R 5/04* (2013.01); *H04R 2430/01* (2013.01)

(56) References Cited

U.S. PATENT DOCUMENTS

| | | | | |
|---|---|---|---|---|
| 2012/0263324 | A1 | 10/2012 | Joyce et al. | |
| 2012/0263325 | A1 | 10/2012 | Freeman et al. | |
| 2012/0263335 | A1 | 10/2012 | Breen et al. | |
| 2013/0022221 | A1 | 1/2013 | Kallai et al. | |
| 2013/0236031 | A1* | 9/2013 | Risberg ..... | H04R 1/24 381/98 |
| 2014/0086415 | A1 | 3/2014 | Sim et al. | |
| 2014/0205133 | A1 | 7/2014 | Freeman et al. | |
| 2015/0208162 | A1 | 7/2015 | Freeman et al. | |
| 2016/0119735 | A1 | 4/2016 | Freeman et al. | |

FOREIGN PATENT DOCUMENTS

| | | | |
|---|---|---|---|
| JP | 5582668 | B2 | 9/2014 |
| WO | WO 2014/035902 | A2 | 3/2014 |

OTHER PUBLICATIONS

Japanese-language Written Opinion (PCT/ISA/237) issued in PCT Application No. PCT/JP2015/083721 dated Feb. 16, 2016 (3 pages).
Extended European Search Report issued in counterpart European Application No. 15864704.0 dated Apr. 24, 2018 (seven (7) pages).

* cited by examiner

SPEAKER DEVICE

CROSS-REFERENCE TO RELATED APPLICATION

This application is a continuation of PCT International Application No. PCT/JP2015/083721, filed Dec. 1, 2015, which claims priority under 35 U.S.C. § 119 from Japanese Patent Application No. JP2014-243296, filed Dec. 1, 2014, the entire disclosure of which are herein expressly incorporated by reference in its entirety.

BACKGROUND

Previously, a speaker system, which uses a plurality of speakers (for example, woofers and tweeters) arranged in a room to provide a comfortable surround effect, has been popular. Meanwhile, the speaker system requires the speakers to be arranged at various places in the room to surround a listener, and the speakers to be connected with acoustic cables. In contrast, there is a so-called "sound bar" or "all-in-one" speaker device, in which a plurality of types of speaker units are incorporated into one device (for example, Patent Literature 1 (Japanese Patent No. 5582668)).

A sound bar and other such speaker devices are connected to a television set, for example, and are used to enjoy high-quality sound along with video. In order to address a reduction in thickness and an increase in size of the television set in recent years, due to design reasons, constraints of installation space, and other such reasons, this type of speaker device is also required to be reduced in thickness. As a result, due to the reduction in thickness, in the speaker device, it has become difficult to arrange multi-way speaker units to the same surface.

The speaker device disclosed in Patent Literature 1 includes a cabinet having a rectangular parallelepiped shape which is long in one direction, and speaker units are provided to adjacent two surfaces (in the document, surface 111 and surface 112) of a plurality of surfaces provided to the cabinet. Of the two surfaces, a speaker unit (in the document, acoustic driver 191), which is optimized for outputting an acoustic signal in a high frequency band, is mounted to one surface, and speaker units (in the document, acoustic drivers 192*a* and 192*b*), which are optimized for outputting acoustic signals in an middle frequency band, are mounted on the other surface. In the speaker device, filter circuits having different passbands are provided for the respective speaker units to filter input 5.1ch acoustic signals, for example, to thereby input, to the respective speaker units, the acoustic signals after being separated into optimal frequency bands.

Incidentally, the above-mentioned speaker device is used in a vertical position or a horizontal position by being rotated by 90° with a longitudinal direction of the cabinet being an axial direction. When an orientation in which the device is installed is changed, the speaker device is changed in type of the speaker unit facing the direction toward the listener. Therefore, when the orientation in which the device is installed is changed, a dominant speaker unit, which forms a sound field at a listening position, is changed. As a result, there arises a problem in that sound quality at the listening position is varied depending on the orientation in which the speaker device is installed.

The technology disclosed in this application has been proposed in view of the above-mentioned problem. It is an object of the technology disclosed in this application to provide a speaker device, which includes speaker units having different diameters and sound emission directions, and which is capable of suppressing variations in sound quality at a listening position, which are caused by changing an orientation in which the speaker device is installed.

SUMMARY

A speaker device according to the technology disclosed in this application includes: a first speaker unit, which is configured to emit a sound corresponding to an acoustic signal that is input thereto; a second speaker unit, to which a sound emission direction that is different from a sound emission direction of the first speaker unit is set, which has a large diameter as compared to the first speaker unit, and to which an acoustic signal containing a frequency band of the acoustic signal input to the first speaker unit is input; a cabinet, to which the first speaker unit and the second speaker unit are provided, and which is installable in two states including a first state in which the sound emission direction of the first speaker unit is directed to a listening position, and a second state in which the sound emission direction of the second speaker unit is directed to the listening position; and sound quality variation suppression means for suppressing a variation in sound quality depending on whether the cabinet is in the first state or the second state.

A speaker device according to the technology disclosed in this application includes: a first speaker unit, which is configured to emit a sound corresponding to an acoustic signal that is input thereto; a second speaker unit, to which a sound emission direction that is different from a sound emission direction of the first speaker unit is set, which has a large diameter as compared to the first speaker unit, and to which an acoustic signal containing a frequency band of the acoustic signal input to the first speaker unit is input; a cabinet, to which the first speaker unit and the second speaker unit are provided, and which is installable in two states including a first state in which the sound emission direction of the first speaker unit is directed to a listening position, and a second state in which the sound emission direction of the second speaker unit is directed to the listening position; detection means for detecting whether the cabinet is in the first state or the second state; and equalizer correction means for correcting frequency characteristics of the acoustic signal input to the first speaker unit and the acoustic signal input to the second speaker unit depending on a detection result from the detection means.

The speaker device includes the first speaker unit and the second speaker unit having different diameters and sound emission directions. The speaker device is capable of directing the sound emission direction of the first speaker unit or the second speaker unit to the listening position by changing an orientation of the cabinet. The equalizer correction means is configured to correct the frequency characteristics of the acoustic signal input to the first speaker unit and the acoustic signal input to the second speaker unit depending on the detection result from the detection means, which is configured to detect the orientation (first state or second state) of the cabinet. The equalizer correction means changes the frequency characteristics so as to correct variations in sound quality at the listening position, which are caused by differences in diameter and sound emission direction of the first speaker unit and the second speaker unit, for example. More specifically, the first speaker unit and the second speaker unit have different diameters, and hence are good at different reproduction frequency bands. In general, the first speaker unit having a small diameter is good at reproducing a high frequency band as compared to the second speaker unit having a larger diameter. Therefore, in the first state in which the sound emission direction of the first speaker unit is directed to the listening position, effects of audio in the high frequency band of the first speaker unit is great to a listener. To the speaker device, acoustic signals having overlapping frequency bands are input to the first speaker unit and the second speaker unit. Therefore, in the first state, the equalizer correction means changes the frequency characteristics so that audio in an middle frequency band, which the first speaker unit is not good at, is emphasized among the frequency bands of audio reproduced from the second speaker unit, to which the sound emission direction is set in a direction different from that toward the listening position, for example. As a result, the variations in sound quality at the listening position, which are caused by changing the orientation in which the speaker device is installed, can be suppressed.

Further, the speaker device according to the technology disclosed in this application may include delay correction means for correcting a delay caused by a difference between distances over which sounds respectively emitted from the first speaker unit and the second speaker unit are transmitted in a space before reaching the listening position, depending on the detection result from the detection means.

The expression "distance over which a sound is transmitted in the space" as used herein means, for example, a distance over which a soundwave emitted from a speaker unit is transmitted directly, or indirectly through reflections and the like, in the space before reaching the listening position. For example, in the first state, the second speaker unit has the sound emission direction set thereto in the direction different from that toward the listening position so that the emitted sound reaches the listening position after being reflected by a wall, a ceiling, and the like, with the result that the distance over which the sound is transmitted in the space is long as compared to the first speaker unit. The sound emitted from the second speaker unit is delayed in time before reaching the listening position as compared to the sound emitted from the first speaker unit. As a result, the listener may feel a sense of discomfort by hearing the sound from the second speaker unit with a delay. In contrast, in the speaker device, delays of the sounds respectively emitted from the first speaker unit and the second speaker unit can be corrected by the delay correction means to align phases of sound waves at the listening position, to thereby allow the listener to hear comfortable sounds without the sense of discomfort.

Further, the speaker device according to the technology disclosed in this application may include level correction means for changing a signal level of the acoustic signal that is input to at least one of the first speaker unit and the second speaker unit, depending on the detection result from the detection means.

The first speaker unit and the second speaker unit have different diameters, and hence different sound pressures of the reproduced sounds. Therefore, in the first state and the second state, the speaker unit facing the listening position is changed, with the result that sound pressure levels of sounds that enter the ears of the listener are also varied. The level correction means performs, in the first state, processing of reducing a level of the acoustic signal input to the first speaker unit, which faces the listening position, and processing of increasing a level of the acoustic signal input to the second speaker unit, which faces a direction that is different from that toward the listening position, for example. As a result, the change in sound pressure at the listening position, which is caused when the orientation in which the speaker device is installed is changed, can be suppressed.

Further, the speaker device according to the technology disclosed in this application may include a third speaker unit, which has a large diameter and is configured to emit a sound in a low frequency band as compared to the first speaker unit and the second speaker unit.

In the speaker device, when 2.1-channel acoustic signals, which include a low tone (LFE) channel containing large components in a low frequency band in addition to two stereo (L and R) channels, are input, for example, the third speaker unit is used to reproduce the sound in the low tone channel, with the result that powerful bass and deep bass, which are difficult to reproduce with only the first speaker unit and the second speaker unit, can be reproduced.

Further, in the speaker device according to the technology disclosed in this application, the cabinet may have a shape that extends to be long in one direction, and have a first surface and a second surface, which are orthogonal to each other, the first speaker unit may include a pair of speaker units, which are respectively provided to both side portions of the first surface in the direction in which the cabinet extends, and the second speaker unit may include a pair of speaker units, which are respectively provided to both side portions of the second surface in the direction in which the cabinet extends.

The speaker device reproduces sounds in a state in which the speaker units, which are arranged on both sides in the extending direction, of each of the first speaker unit and the second speaker unit are arranged on both sides of the listener in a left and right direction (horizontal direction), for example, to thereby allow the listener to hear sounds with a feeling of spreading. Moreover, the speaker device has the first speaker unit, which has the small diameter, provided to the first surface. Therefore, the first surface can be reduced in length in a direction orthogonal to the extending direction in accordance with the diameter of the first speaker unit. In other words, the speaker device can be reduced in thickness and size. Therefore, it is effective to apply the speaker device to the so-called sound bar, which has been required to be reduced in thickness in recent years.

DETAILED DESCRIPTION

Figure 1:
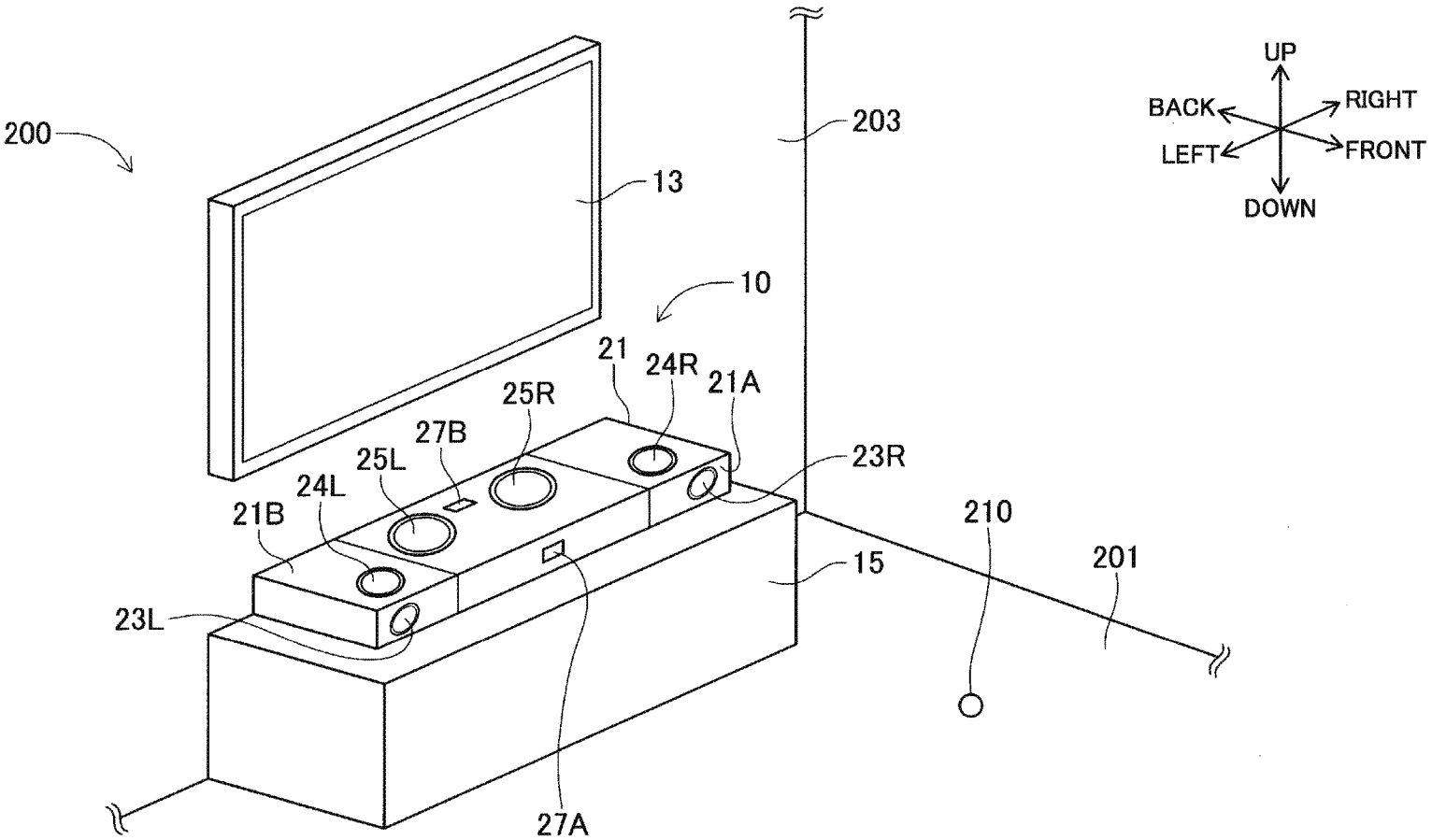
FIG. 1 A perspective view for illustrating a state in which a speaker device according to an embodiment of the present invention is arranged on a rack in a room.

Now, one embodiment for embodying the present invention is described with reference to the accompanying drawings. FIG. 1 is a perspective view for illustrating a room 200 in which a speaker device 10, which is one embodiment of the invention of the subject application, a television set 13, which is connected to the speaker device 10, and a rack 15, on which the speaker device 10 is placed, are installed. In the following description, as illustrated in FIG. 1, the description is given with a direction perpendicular to a floor 201 of the room 200 being defined as an up and down direction, a direction from the speaker device 10 toward a listening position 210 being defined as a front direction, and a direction toward the left and right of the speaker device 10 when viewed from the listening position 210 being defined as a left and right direction.

As illustrated in FIG. 1, the television set 13 is mounted along a wall 203. The rack 15 is arranged below the television set 13 and on the floor 201 in a state in which a rear surface thereof is placed along the wall 203. The speaker device 10 is placed on the rack 15, and is located below the television set 13. The speaker device 10 and the television set 13 are connected to each other via a cable connected to a High Definition Multimedia Interface (HDMI) (trademark) terminal (see FIG. 3), for example, and are capable of reproducing audio and video in synchronization with each other.

Figure 2:
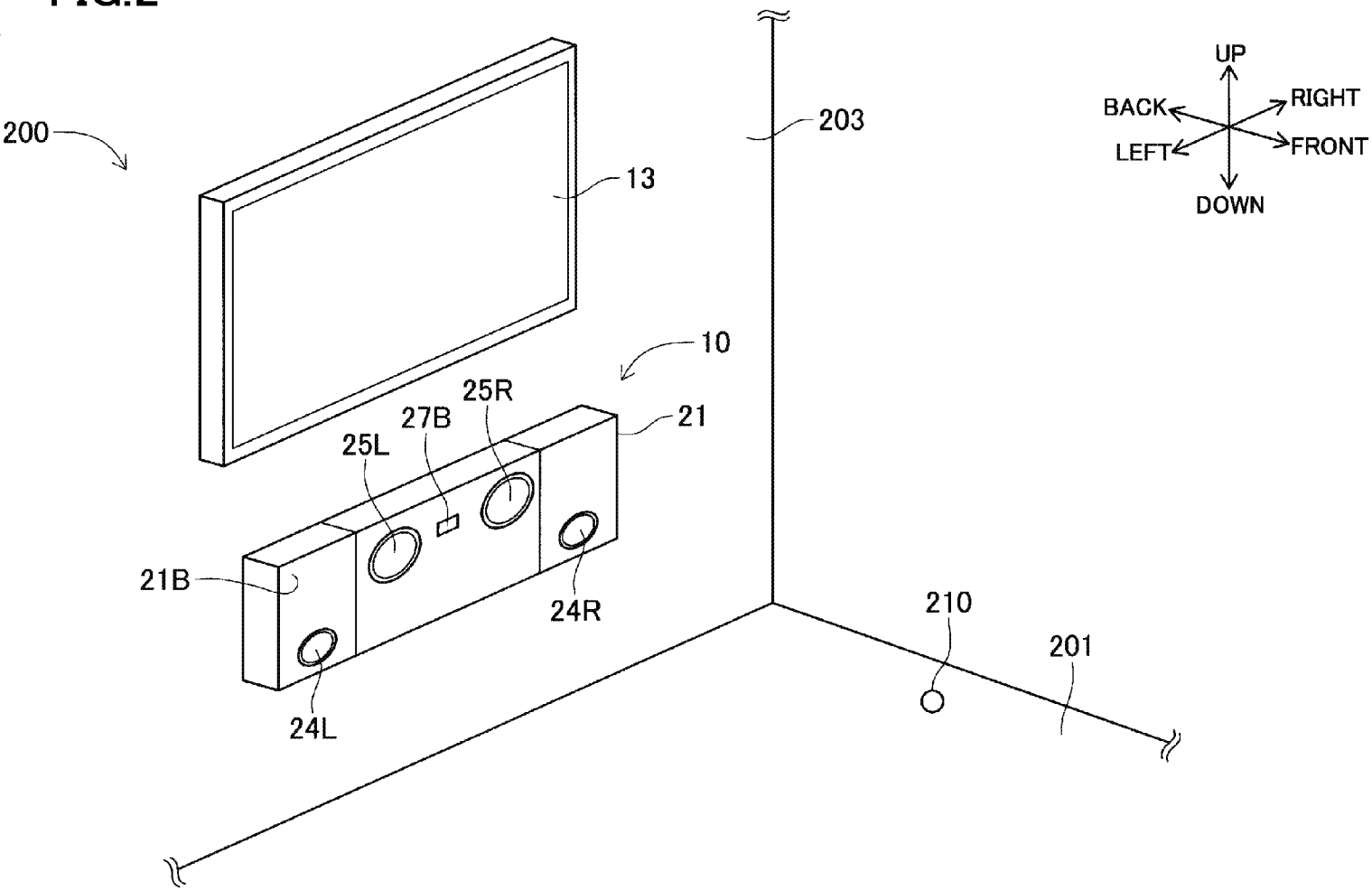
FIG. 2 A perspective view for illustrating a state in which the speaker device according to the embodiment is hung on a wall in the room.

The speaker device 10 is long in one direction (in the figures, left and right direction), and has a casing 21 having a rectangular parallelepiped shape, which has a long width in a front and back direction as compared to a width in the up and down direction. The casing 21 has a total of six speaker units mounted thereto, and of adjacent surfaces 21A and 21B (in the figures, front surface and top surface), two first speaker units 23 are mounted to the surface 21A, and two second speaker units 24 and two third speaker units 25 are mounted to the surface 21B. The speaker device 10 stores, in a memory 55 (see FIG. 3), music input from acoustic cables connected to a personal computer, an external hard disk drive, or the like in addition to the television set 13 illustrated in FIG. 1, and music input via a network or the like, for example, and reproduces the stored music from the built-in speaker units 23 to 25. The speaker device 10 according to this embodiment is a device that can be used by changing an orientation of the casing 21 as illustrated in FIG. 2, which is to be described later.

In the state illustrated in FIG. 1, the speaker device 10 has the two first speaker units 23 mounted to the front surface 21A facing the listening position 210 side. The two first speaker units have similar structures, but when distinguished for the description, are described with letters suffixed to the reference numerals, such as a first speaker unit 23L (left) and a first speaker unit 23R (right), as illustrated in FIG. 1. The same applies to the other second speaker units 24L and 24R and third speaker units 25L and 25R.

In the state illustrated in FIG. 1, the surface 21A is in a state in which its plane is aligned with the up and down direction and the left and right direction. The casing 21 has the first speaker unit 23L mounted to a left end portion of the surface 21A, and the first speaker unit 23R mounted to a right end portion of the surface 21A. The two first speaker units 23L and 23R are both in a state of facing the listening position 210.

Moreover, the first speaker units 23 have a small diameter as compared to the other second and third speaker units 24 and 25. The term "diameter" as used herein refers to a diameter of a cone-shaped diaphragm, for example. Moreover, the first and second speaker units 23 and 24 in this embodiment have similar structures as full-range speakers, though with the different diameters. In general, a speaker unit is good at reproducing a higher frequency band as the diameter becomes smaller, and is good at reproducing a lower frequency band as the diameter becomes larger. Therefore, the first speaker units 23 have the structure having the small diameter and being good at reproducing the high frequency band as compared to the second speaker units 24. For example, the first speaker units 23 function as tweeters, which are optimized for outputting a sound having a higher frequency in an audible frequency range.

In the state illustrated in FIG. 1, the surface 21B faces upward, and is in a state in which its plane is aligned with the front and back direction and the left and right direction. The casing 21 has the second speaker unit 24L mounted to a left end portion of the surface 21B, and the second speaker unit 24R mounted to a right end portion of the surface 21B. The second speaker units 24 are in a state of facing an upward direction, which is orthogonal to the direction of the first speaker units 23. The second speaker units 24 have the structure having a large diameter as compared to the first speaker units 23, and a small diameter as compared to the third speaker units 25, and being good at reproducing an middle frequency band. For example, the second speaker units 24 function as woofers, which are optimized for outputting a sound having a frequency in an middle frequency band in the audible frequency range.

Moreover, the third speaker units 25 are mounted to the surface 21B. The casing 21 has, in the left and right direction, the third speaker unit 25L mounted to an inner portion with respect to the second speaker unit 24L, and the third speaker unit 25R mounted to an inner portion with respect to the second speaker unit 24R. As with the second speaker units 24, the third speaker units 25 are in a state of facing the upward direction. The third speaker units 25 have the structure having a large diameter as compared to the first and second speaker units 23 and 24, and being good at reproducing an even lower frequency band, and function as subwoofers.

Moreover, the speaker device 10 includes two receiving units 27A and 27B, which are configured to receive an infrared ray from an infrared remote controller 230 (see FIG. 3) included with the speaker device 10. The receiving unit 27A is provided at a center portion of the surface 21A in the left and right direction. The receiving unit 27B is provided at a center portion of the surface 21B in the left and right direction, and at a position on the rear side between the third speaker units 25. In the state illustrated in FIG. 1, the receiving unit 27A is in a state of facing the listening position 210 side (front direction), and the receiving unit 27B is in a state of facing upward.

In FIG. 2, there is illustrated a state of installation after changing an orientation in which the speaker device 10 is installed. In the state illustrated in FIG. 2, the speaker device 10 is in a state in which the orientation of the casing 21 is rotated by 90° about an axis along the left and right direction (longitudinal direction of the casing 21) such that the surface 21B faces the listening position 210 side. As with the television set 13, the speaker device 10 is mounted on the wall 203 with a mounting member (not shown). In the state illustrated in FIG. 2, the speaker device 10 is in a state in which the second and third speaker units 24 and 25 face the listening position 210. Moreover, of the receiving units 27A and 27B, the receiving unit 27B is in a state of facing the listening position 210 side. The speaker device 10 is in a state in which the surface 21A (see FIG. 1) faces downward, and the first speaker units 23 and the receiving unit 27A face the floor 201.

The speaker device 10 according to this embodiment reproduces audio from all the speaker units 23 to 25 without switching inputs of acoustic signals to the first to third speaker units 23 to 25 in any one of the states of FIG. 1 and FIG. 2. Here, the first to third speaker units 23 to 25 have mutually different diameters, and hence different directivities of the emitted sounds. A speaker unit generally has a higher directivity as the diameter becomes smaller. The state illustrated in FIG. 1 and the state illustrated in FIG. 2 are different in directions of the first to third speaker units 23 to 25, which have such directivities, with respect to the listening position 210, and hence dominant speaker units, which form a sound field at the listening position 210, are changed. For example, in the state illustrated in FIG. 1, the first speaker unit 23 facing the listening position 210 is dominant as compared to the other speaker units 24 and 25, and hence has a larger effect on the sound heard by the ears of a listener 220 (see FIG. 3). Therefore, even when the same music is reproduced, the sound quality at the listening position 210 is varied between the states of FIG. 1 and FIG. 2, which is a problem. To address this problem, the speaker device 10 according to this embodiment performs processing of suppressing variations in sound quality at the listening position 210, which are caused by such difference in orientation of the installation. As a result, when the orientation of the installation is changed, the speaker device 10 achieves the reproduction of the audio suppressing the variations in sound quality while outputting from all the speaker units 23 to 25, instead of switching the speaker units to output.

Figure 3:
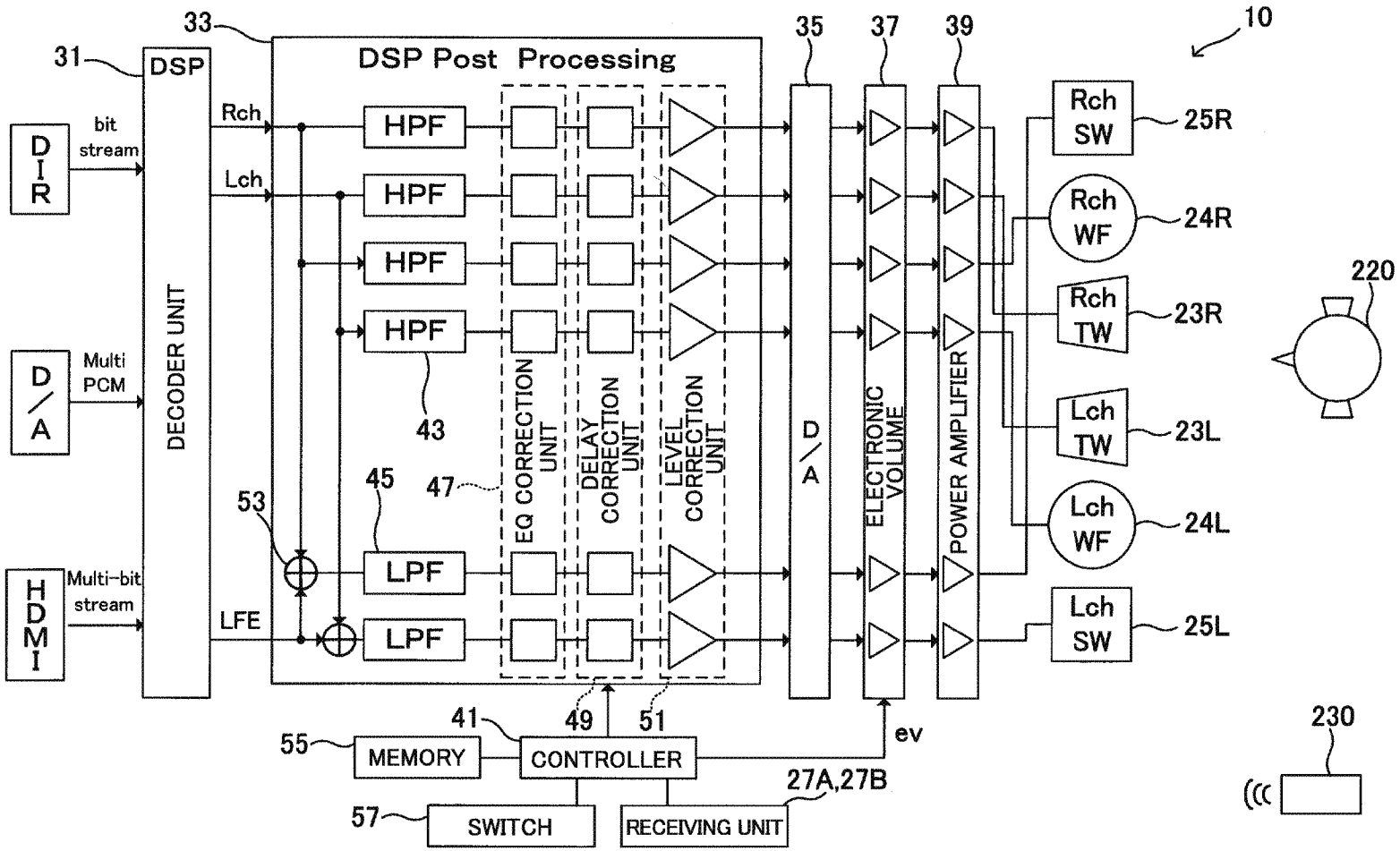
FIG. 3 A block diagram for illustrating a configuration of the speaker device.

FIG. 3 is a block diagram for illustrating a configuration of the speaker device 10. As illustrated in FIG. 3, the speaker device 10 includes a decoder unit 31, a post-processing unit 33, a D/A converter 35, an electronic volume 37, a power amplifier (power amplification circuit) 39, a controller 41 configured to perform centralized control on those components, and the like. The decoder unit 31 and the post-processing unit 33 are achieved by a digital signal processor (DSP), for example.

The decoder unit 31 receives acoustic signals from a DVD player, a Super Audio CD player, or other such digital audio equipment in addition to the television set 13, and outputs, for example, multi-channel signals having 2.1 channels. The decoder unit 31 receives a bitstream signal from a digital interface receiver (DIR), a multi-channel PCM signal from the D/A converter, and a multi-channel bitstream signal from the High Definition Multimedia Interface (HDMI) (trademark) terminal, for example, and decompresses data compressed with Dolby Digital, Digital Theater Systems (DTS), Advanced Audio Coding (AAC), or other such standards. The decoder unit 31 output a 2.1-channel signal including, in addition to a left (L) channel and a right (R) channel, a low tone (LFE) channel containing large components in a low frequency band.

The post-processing unit 33 includes four high-pass filters 43, two low-pass filters 45, an equalizer correction unit 47, a delay correction unit 49, a level correction unit 51, and the like. The post-processing unit 33 outputs two stereo channel (L and R) signals input from the decoder unit 31 to the equalizer correction unit 47 via the high-pass filters 43 corresponding to the left and the right of each of the first and second speaker units 23 and 24. The high-pass filters 43 attenuate components in a frequency band that is a predetermined cutoff frequency or less, and selectively allow frequency band components corresponding to reproduction frequency bands of the first and second speaker units 23 and 24 to pass therethrough. The cutoff frequency of the high-pass filters 43 is 100 Hz, for example. Therefore, the speaker device 10 according to this embodiment receive the acoustic signals having the same frequency band (for example, middle frequency band or more) input to the first speaker units 23 and the second speaker units 24 having different diameters and sound emission directions.

Moreover, in the post-processing unit 33, the two channel (L and R) signals and the low tone (LFE) channel signal, which are input from the decoder unit 31, are input to adders 53 corresponding to the left and the right of the third speaker units 25, respectively. One adder 53 adds the LFE channel signal and the L channel signal and outputs the result, to a low-pass filter 45, as a left output signal to be output from the third speaker unit 25L. Moreover, another adder 53 adds the LFE channel signal and the R channel signal, and outputs the result, to another low-pass filter 45, as a right output signal to be output from the third speaker unit 25R. The low-pass filters 45 attenuate components in a frequency band that is a predetermined cutoff frequency or more, and selectively output, to the equalizer correction unit 47, a frequency band component corresponding to a reproduction frequency band of the third speaker units 25.

The equalizer correction unit 47 corrects a difference between frequency characteristics of the first and second speaker units 23 and 24, which are good at different frequency bands because of the difference between the diameters. The first speaker units 23 have a relatively small diameter, and hence are good at reproducing audio in the high frequency band as compared to the second speaker units 24. Reproduction of the middle frequency band is complemented by the second speaker units 24.

Moreover, as described above, between the states illustrated in FIG. 1 and FIG. 2, the dominant speaker units are changed. For example, in the state illustrated in FIG. 1, the effects of the first speaker units 23, that is, the effects of the audio in the higher frequency band is larger for the ears of the listener 220. The second speaker units 24 receive the acoustic signals having the same frequency band as that of the first speaker units 23. Therefore, the equalizer correction unit 47 performs, on the acoustic signals input to the second speaker units 24, processing of emphasizing an middle frequency band, which the first speaker units 23 are not good at, for example. Alternatively, the equalizer correction unit 47 performs, on the acoustic signals input to the dominant first speaker units 23, processing of attenuating a high frequency band, for example. In this manner, the equalizer correction unit 47 performs processing for complementing a frequency band that is short as the audio to be supplied to the listening position 210, or suppressing a frequency band that is supplied excessively by emphasizing or attenuating the frequency band which the first and second speaker units 23 and 24 are good at or not good at.

Moreover, in the case illustrated in FIG. 2, the equalizer correction unit 47 performs processing opposite to the case illustrated in FIG. 1. Specifically, the equalizer correction unit 47 performs, on the acoustic signals input to the first speaker units 23, processing of emphasizing the high frequency band, which the second speaker units 24 are not good at, and performs, on the acoustic signals input to the second speaker units 24, processing of attenuating the middle frequency band, for example. In the case where the acoustic signals input to the third speaker units 25 contain parts overlapping with the frequency bands of the acoustic signals input to the first and second speaker units 23 and 24, and in other such cases, the equalizer correction unit 47 may perform similar processing also on the acoustic signals input to the third speaker units 25.

The delay correction unit 49 corrects a delay of the audio at the listening position 210, which is changed for each of the states illustrated in FIG. 1 and FIG. 2. The sound emitted from the speaker device 10 is ideally felt by the listener 220 at the listening position 210 as if the sound comes from one point sound source in the front. However, for example, in the state illustrated in FIG. 1, the second and third speaker units 24 and 25 face upward, and a distance over which sounds are transmitted from the speaker units 24 and 25 to the listening position 210 in the room 200 is longer than a distance over which the sounds from the first speaker units 23 are transmitted. As a result, the sounds emitted from the second and third speaker units 24 and 25 are delayed before reaching the listening position 210. Similarly, in the state illustrated in FIG. 2, the sounds emitted from the first speaker units 23 are delayed because of the longer distance over which the sounds are transmitted. Therefore, the listener 220 may feel a sense of discomfort of sounds emitted from not the point sound source but a plurality of sound sources because the sounds simultaneously emitted from the respective speaker units 23 to 25 enter the ears at different timings.

Moreover, when sounds emitted from one of the first and second speaker units 23 and 24 and sounds delayed from the sounds by a predetermined period of time repeatedly reach the listening position 210, peaks and dips in the frequency characteristics are periodically generated. As a result, for example, sound in a particular frequency band in the audible frequency range may be emphasized or muffled. To address this problem, the delay correction unit 49 adds, in order to correct the delay of the sounds in each state, in the state illustrated in FIG. 1, a delay corresponding to the difference between the distances over which the sound is transmitted during a period from the timing at which the sounds are emitted from the second and third speaker units 24 and 25 to the timing at which the sounds are emitted from the first speaker units 23, for example. As a result, even when the orientation in which the speaker device 10 is installed is changed, phases of sound waves reaching the listening position 210 from the respective speaker units 23 and 24 are ideally aligned so that the feeling of the sounds coming from the point sound source may be given to the listener 220 without the sense of discomfort. The delay correction unit 49 may perform similar processing also on the acoustic signals input to the third speaker units 25.

Moreover, the first and second speaker units 23 and 24 have the different diameters, and hence have different sound pressures of the sounds to be reproduced. Therefore, in the respective states illustrated in FIG. 1 and FIG. 2, the speaker units facing the listening position 210 are changed, and hence the sound pressure levels of the sounds entering the ears of the listener 220 are also changed. The level correction unit 51 is configured to perform processing for suppressing such change in sound pressure level. More specifically, in the state illustrated in FIG. 1, the level correction unit 51 performs at least one of processing of reducing levels of the acoustic signals input to the first speaker units facing the listening position 210 side, and processing of increasing levels of the acoustic signals input to the second speaker units 24, for example. Ideally, with the same volume value ev of the electronic volume 37, even when the orientation in which the speaker device 10 is installed is changed, it is preferred that the level correction unit 51 make adjustments so that the sound pressure may be the same at the listening position 210. The sound pressure level adjusted by the level correction unit 51 may be set by performing a simulation and an actual measurement in advance.

Digital acoustic signals processed by the correction units 47, 49, and 51 of the post-processing unit 33 are input to the D/A converter 35. The D/A converter 35 is configured to convert the digital acoustic signals into analog acoustic signals to output the obtained analog acoustic signals to the electronic volume 37. The electronic volume 37 is configured to adjust voltage levels of the acoustic signals with the volume value ev instructed from the controller 41.

The controller 41 is a processing circuit mainly formed of a central processing unit (CPU), for example. The controller 41 detects the orientation of the casing 21, and sets details of acoustic processing by the above-mentioned correction units 47, 49, and 51 and performs other such control depending on the detected orientation. The speaker device 10 includes a switch 57 (for example, dual in-line package (DIP) switch) as detection means for detecting the orientation of the casing 21. The switch 57 is provided on a rear surface (in FIG. 1, surface being opposed to the surface 21B in the up and down direction) of the speaker device 10. The listener 220 operates the switch 57 depending on the orientation in which the speaker device 10 is installed. In this manner, the controller 41 may detect the orientation on the basis of ON/OFF of the switch 57. Without limiting to the switch 57, the detection means may be a sensor (e.g., gyro sensor). In this case, the speaker device 10 may automatically detect the orientation.

Moreover, each of the receiving units 27A and 27B decodes an infrared code signal transmitted from the infrared remote controller 230, and outputs a result of the decoding to the controller 41. The controller 41 increases or decreases the volume value ev of the electronic volume 37 depending on the code signal input from each of the receiving units 27A and 27B, for example. As a result, the listener 220 may change a volume of the sound to be reproduced by operating the infrared remote controller 230. The controller 41 may turn the power of the speaker device 10 ON and OFF, switch a source from which the acoustic signals are input, or change the details (e.g., set value for equalizing by the equalizer correction unit 47) of the acoustic processing based on a decoded signal, for example.

Moreover, the memory 55 included in the speaker device 10 is configured to store various kinds of data and programs for use in control by the controller 41, and stores programs executed in the DSP, e.g., the post-processing unit 33, for example.

Then, the electronic volume 37 outputs acoustic signals having adjusted voltage values to the power amplifier 39. The power amplifier 39 is configured to amplify the input acoustic signals to be output to the first to third speaker units 23 to 25. The speaker device 10 outputs a left output signal from the first speaker unit 23L, and a right output signal from the first speaker unit 23R, for example. In this manner, the speaker device 10 executes the reproduction of the sound depending on the orientation of the device.

Incidentally, the casing 21 is an example of a cabinet. The equalizer correction unit 47 is an example of equalizer correction means. The delay correction unit 49 is an example of delay correction means. The level correction unit 51 is an example of level correction means. The switch 57 is an example of the detection means. The surface 21A is an example of a first surface. The surface 21B is an example of a second surface.

As described above, according to the embodiment described above, the following effects are obtained. The speaker device 10 has the first and second speaker units 23 and 24, which have different diameters and sound emission directions, mounted thereto. The speaker device 10 is installable in the following two states: the state of being placed on the rack 15 with the first speaker units 23 facing the listening position 210 as illustrated in FIG. 1; and the state of being hung on the wall 203 with the second speaker units 24 facing the listening position 210 as illustrated in FIG. 2. Moreover, the speaker device 10 includes the switch 57, which is operated by the listener 220 depending on the orientation in which the device is installed, and the controller 41 detects the orientation depending on ON/OFF of the switch 57. The controller 41 controls the equalizer correction unit 47 depending on the orientation of the casing 21. The equalizer correction unit 47 corrects the frequency characteristics of the acoustic signals, which are input to the first and second speaker units 23 and 24, so that the sound quality is not varied at the listening position 210 depending on the difference in diameter and sound emission direction of the speaker units 23 and 24. As a result, the variations in sound quality at the listening position 210, which are caused by changing the orientation in which the speaker device 10 is installed, can be suppressed.

The delay correction unit 49 corrects the delays of the respective sounds emitted from the first and second speaker units 23 and 24 to align the phases of the sound waves at the listening position 210. As a result, the listener 220 is allowed to hear comfortable sounds without the sense of discomfort.

In order to suppress the change in sound pressure level caused by the difference in diameter of the first and second speaker units 23 and 24, the level correction unit 51 performs, in the state illustrated in FIG. 1, the processing of reducing the levels of the acoustic signals input to the first speaker units 23 facing the listening position 210 side, for example. As a result, the change in sound pressure at the listening position 210, which is caused when the orientation in which the speaker device 10 is installed is changed, can be suppressed.

The speaker device 10 includes, in addition to the first and second full-range speaker units 23 and 24 having different diameters, the third speaker units 25 as the subwoofers for reproducing the low tone. As a result, when the 2.1-channel acoustic signals are input, the speaker device 10 uses the third speaker units 25 to reproduce the sound in a low tone channel so that powerful bass and deep bass, which are difficult to reproduce with only the first and second speaker units 23 and 24, can be reproduced.

The speaker device 10 includes a left-side unit and a right-side unit of each of the speaker units 23 to 25 arranged in a distributed manner to the both side portions in the left and right direction in which the casing 21 extends, and is configured to emit the sounds with the feeling of spreading in the left and right direction (horizontal direction) to the listener 220. Moreover, the speaker device 10 has only the first speaker units 23, which have the smallest diameter of the three types of speaker units 23 to 25, provided on the surface 21A so that, as illustrated in FIG. 1, a length of the surface 21A in the up and down direction (direction orthogonal to the longitudinal direction of the casing 21) may be reduced in accordance with the diameter of the first speaker units 23. As a result, the speaker device 10 can be reduced in width in the up and down direction, and hence in thickness.

The present invention is not limited to the above-mentioned embodiment, and it should be understood that various alterations and modifications may be made without departing from the spirit of the present invention.

For example, the post-processing unit 33 includes the three correction units 47, 49, and 51, but may be configured to adjust the sound quality with only the equalizer correction unit 47. In this case, circuit portions relating to the other delay correction unit 49 and level correction unit 51 are unnecessary.

Moreover, in the above-mentioned embodiment, the acoustic signals are input to the third speaker units 25 via the correction units 47, 49, and 51, but there may be adopted a configuration in which no correction processing is performed on the acoustic signals input to the third speaker units 25.

Moreover, the speaker device 10 may not include the third speaker units 25 for reproducing the low tone.

Moreover, there has been adopted the configuration in which the three correction units 47, 49, and 51 are achieved by executing corresponding programs by the DSP, but the correction units 47, 49, and 51 may be implemented in hardware including an arithmetic circuit and the like.

Moreover, in the above-mentioned embodiment, the acoustic signals in the same frequency band (middle frequency band or more) are input to the first and second speaker units 23 and 24, but the acoustic signals input the first and second speaker units 23 and 24 may not be the same in all the frequency band, but may have partially overlapping frequency bands.

Moreover, the orientation and the position in which the speaker device 10 is installed, which are illustrated in FIG. 1 and FIG. 2, are merely an example, and may be changed as appropriate. For example, the speaker device 10 may be installed in a state in which the first speaker units 23 face upward (ceiling side), and in which the second and third speaker units 24 and 25 face the listening position 210. In this case, the left and right positions of each of the speaker units 23 to 25 are reversed, and hence a circuit configured to switch acoustic signals input to the speaker units (such as first speaker unit 23L) on the left side and the speaker units (such as first speaker unit 23R) on the right side, and other such components may be included in the speaker device 10.

Moreover, the speaker device 10 does not need to be arranged along the wall 203, but may be arranged at a position separated from the wall 203 by a certain distance.

Moreover, the method of fixing the position of the speaker device 10 is merely an example, and in the case illustrated in FIG. 1, the speaker device 10 may be fixed to the wall 203 instead of being placed on the rack 15, for example.

Moreover, the signals input to the speaker device 10 are not limited to the 2.1ch signals, but may be 2ch stereo signals. In this case, the speaker device 10 may be configured to input the low frequency band, which cannot be reproduced by the first and second speaker units 23 and 24, to the third speaker units 25. Moreover, the signals input to the speaker device 10 may be multi-channel signals exceeding 2.1ch. In this case, there may be adopted a configuration in which sounds in back and overhead surround channels are generated from a plurality of speakers installed in the front without installing speakers behind and above the listener 220, to thereby perform so-called "virtual surround reproduction". More specifically, the speaker device 10 may have a configuration including a localization addition processing unit, which is configured to localize signals in a back channel of the input acoustic signals to a virtual speaker position behind the listener 220, and a crosstalk canceling unit, which is configured to allow, of left output signals and right output signals of the acoustic signals, only the left output signals emitted from the speaker units to reach the left ear of the listener 220, and only the right output signals emitted from the speaker units to reach the right ear of the listener 220, for example.

Moreover, the number, shapes, positions, and the like of the components of the speaker device 10 in the above-mentioned embodiment are merely an example, and may be changed as appropriate. For example, the casing 21 has the rectangular parallelepiped shape extending in the left and right direction. However, the present invention is not limited thereto, and the shape may be changed as appropriate to another shape, for example, a rounded shape, an elliptical shape, or a curved shape.

What is claimed is:

1. A speaker device, comprising:

a cabinet having a first surface and a second surface, the first surface being different from the second surface;

a first speaker unit provided at the first surface and configured to emit a sound corresponding to a first acoustic signal that is input into the first speaker unit and a second speaker unit provided at the second surface and configured to emit a sound corresponding to a second acoustic signal that is input into the second speaker unit;

the cabinet being configurable in a first installed state or a second installed state, wherein the first speaker unit faces a listening position in the first installed state and the second speaker unit faces the listening position in the second installed state; and at least one processor for executing stored instructions to:

determine whether the cabinet is in the first installed state or the second installed state, and perform processing on a frequency band of the first acoustic signal or the second acoustic signal depending on whether the cabinet is in the first installed state or the second installed state.

2. The speaker device according to claim 1, wherein processing the acoustic signal comprises the at least one processor to correct frequency characteristics of at least one of the first acoustic signal input to the first speaker unit and the second acoustic signal input to the second speaker unit.

3. The speaker device according to claim 2, wherein correcting the frequency characteristics comprises the at least one processor to emphasize a middle frequency band of the second acoustic signal input to the second speaker unit when the cabinet is in the first state.

4. The speaker device according to claim 2, wherein processing the acoustic signal comprises the at least one processor to attenuate a high frequency band of the first acoustic signal input to the first speaker unit when the cabinet is in the first state.

5. The speaker device according to claim 2, wherein processing the acoustic signal comprises the at least one processor to emphasize high frequency characteristics of the first acoustic signal input to the first speaker unit when the cabinet is in the second state.

6. The speaker device according to claim 2, wherein processing the acoustic signal comprises the at least one processor to attenuate a middle frequency band of the second acoustic signal input to the second speaker unit when the cabinet is installed in the second state.

7. The speaker device according to claim 1, wherein the at least one processor further corrects a delay depending on whether the cabinet is in the first state or the second state, the delay caused by a difference between distances over which sounds respectively emitted from the first speaker unit and the second speaker unit are transmitted in a space before reaching a listening position.

8. The speaker device according to claim 1, wherein the at least one processor further changes a signal level of at least one of the first acoustic signal that is input to the first speaker unit and the second acoustic signal that is input to the second speaker unit depending on whether the cabinet is in the first state or the second state.

9. The speaker device according to claim 1, further comprising a third speaker unit that has a large diameter and is configured to emit a sound in a low frequency band as compared to the first speaker unit and the second speaker unit.

10. The speaker device according to claim 1, wherein the cabinet has a shape extending longitudinally in one direction, and has a first surface and a second surface that is orthogonal to the first surface, wherein the first speaker unit is provided on the first surface, wherein the second speaker unit is provided on the second surface, and wherein the first surface has a width that is smaller than a width of the second surface.

11. The speaker device according to claim 10, wherein the speaker device further comprises, on the second surface, a third speaker unit that has a large diameter and is configured to emit a sound in a low frequency band as compared to the first speaker unit and the second speaker unit.

12. The speaker device according to claim 1, wherein the cabinet has a shape extending longitudinally in one direction, and has a first surface and a second surface that is orthogonal to the first surface, wherein the first speaker unit comprises a pair of speaker units that are respectively provided to both side portions of the first surface in a direction in which the cabinet extends, and wherein the second speaker unit comprises a pair of speaker units that are respectively provided to both side portions of the second surface in a direction in which the cabinet extends.

13. The speaker device according to claim 1, wherein the first state is when the first speaker unit is directed to a listening position, and the second state is when the second speaker unit is directed to the listening position.

14. The speaker device according to claim 1, wherein the second speaker unit has a diameter that is greater than a diameter of the first speaker unit.

15. The speaker device according to claim 14, wherein the sound produced by the first speaker unit is in a high frequency band and the sound produced by the second speaker unit is in an intermediate frequency band.

* * * * *